US008042708B2

(12) United States Patent
Jeong et al.

(10) Patent No.: US 8,042,708 B2
(45) Date of Patent: Oct. 25, 2011

(54) DISPENSER AND REFRIGERATOR INCLUDING THE SAME

(75) Inventors: Kyung Han Jeong, Seoul (KR); Seong Jae Kim, Seoul (KR); Dong Jeong Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 906 days.

(21) Appl. No.: 11/941,438

(22) Filed: Nov. 16, 2007

(65) Prior Publication Data

US 2008/0156027 A1 Jul. 3, 2008

(30) Foreign Application Priority Data

Dec. 31, 2006 (KR) ..... 10-2006-0139250

(51) Int. Cl.
*F25D 11/00* (2006.01)

(52) U.S. Cl. ..... 222/146.6; 222/504; 222/639; 222/425; 222/559; 62/389

(58) Field of Classification Search ..... 222/504, 222/146.6, 639, 425, 448, 505, 559, 561, 222/509; 62/389
See application file for complete search history.

(56) References Cited

U.S. PATENT DOCUMENTS 3,918,616 A * 11/1975 Goldsmith ..... 222/504
4,253,400 A 3/1981 Fischer et al.
4,898,308 A * 2/1990 Rudick ..... 222/325
4,921,149 A * 5/1990 Miller et al. ..... 222/639
5,058,773 A 10/1991 Brill et al.
5,190,182 A 3/1993 Copas
6,516,975 B2 * 2/2003 Green ..... 222/202
7,703,297 B2 * 4/2010 Bowen et al. ..... 62/344

FOREIGN PATENT DOCUMENTS

| | | |
|---|---|---|
| EP | 1519131 | 3/2005 |
| KR | 10-1997-0000101 | 1/1997 |
| KR | 1020050028360 A | 3/2005 |
| KR | 10-0510698 | 8/2005 |
| KR | 10-0512000 | 8/2005 |

OTHER PUBLICATIONS

Korean Office Action dated Oct. 31, 2007.
International Search Report dated May 20, 2008.
Written Opinion of the International Searching Authority.
Korean Notice of Allowance issued in KR Application No. 10-2006-0139250 dated Apr. 28, 2008.
International Search Report and Written Opinion issued in PCT/KR2007/005739 dated May 20, 2008.

* cited by examiner

*Primary Examiner* — Kevin P Shaver
*Assistant Examiner* — Donnell Long
(74) *Attorney, Agent, or Firm* — KED & Associates, LLP

(57) ABSTRACT

A dispenser for a refrigerator is provided that increases a usable space of a storage compartment of the refrigerator. The dispenser includes a chute which receives contents from an inside of the refrigerator and discharges the contents to an outside through an opening provided on an end of the chute. A cover selectively opens or shuts the opening. A first unit causes the cover to slide relative to the opening so as to open or shut the opening.

17 Claims, 17 Drawing Sheets

DISPENSER AND REFRIGERATOR INCLUDING THE SAME

CROSS-REFERENCE TO RELATED APPLICATION

This application claims the benefit of Korean Patent Application No. 10-2006-0139250 filed in Korea on Dec. 31, 2006, the entirety of which is incorporated herein by reference.

BACKGROUND

1. Field

This relates to a dispenser for a refrigerator, and, more particularly, to a dispenser that dispenses contents such as, for example, ice and/or water from a refrigerator.

2. Background

Dispensers are typically provided in a freezing chamber door of a refrigerator to allow ice or water to be easily dispensed without opening the door. However, the placement of dispensers and/or corresponding structure to make and dispense ice and/or water on the inside of the door detracts from the usable space within the storage chamber. Further, access to electrical and mechanical ice making components through a dispensing chute can present a hazard if foreign objects are introduced through a dispensing chute. Additionally, cold air can be lost through the dispensing chute, and warm air can be introduced into the refrigerator through the dispensing chute, thus degrading efficiency of the refrigerator.

BRIEF DESCRIPTION OF THE DRAWINGS

The embodiments will be described in detail with reference to the following drawings in which like reference numerals refer to like elements wherein.

DETAILED DESCRIPTION

Reference will now be made in detail to embodiments, examples of which are illustrated in the accompanying drawings. Wherever possible, the same reference numbers will be used throughout the drawings to refer to the same or like parts.

Figure 1A:
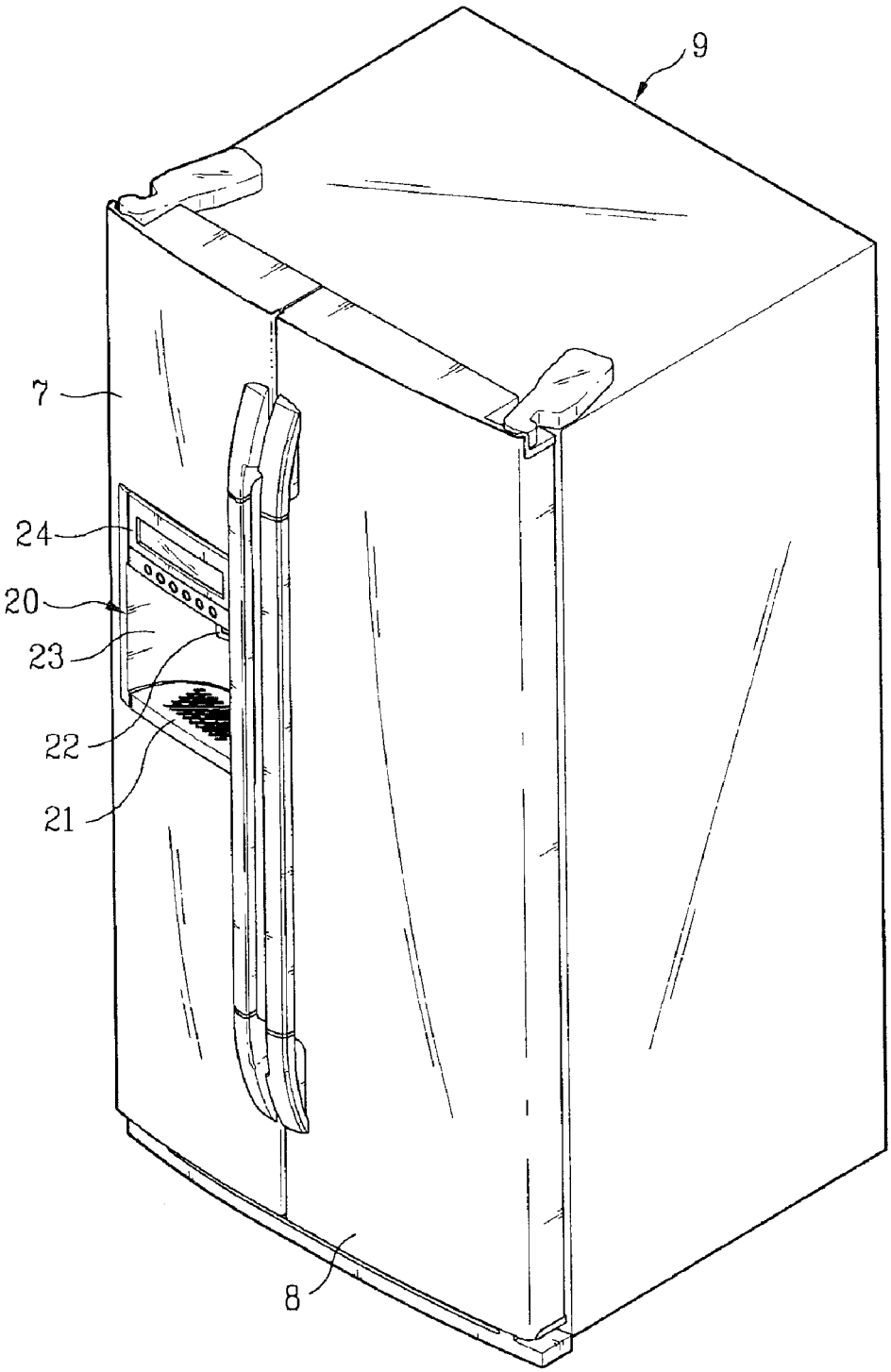
FIGS. 1A-1C are perspective views of exemplary refrigerators including dispensers as embodied and broadly described herein.
Figure 1B:
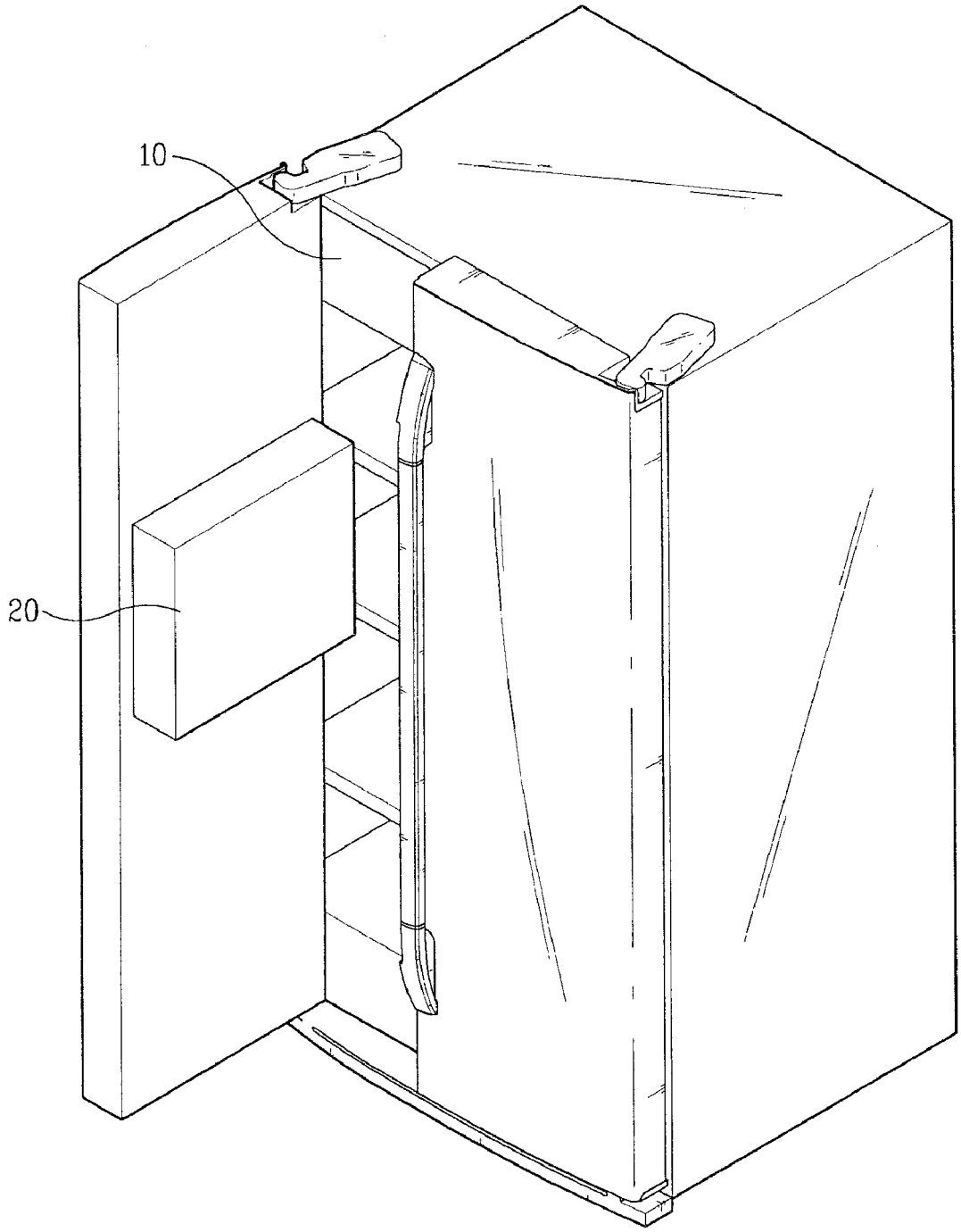
Figure 1C:
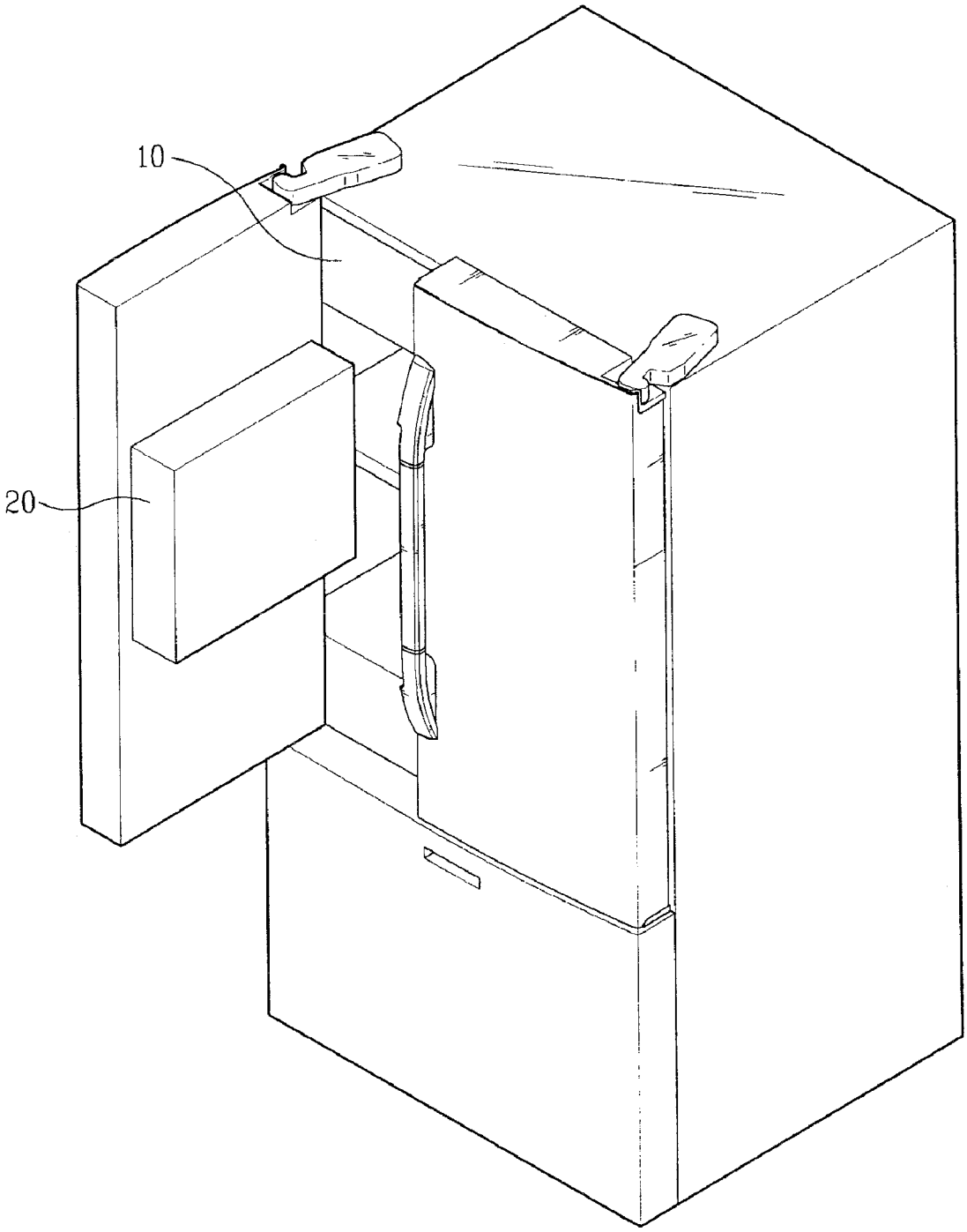

As shown in FIGS. 1A-1B, an exemplary refrigerator 9 may include a freezing chamber and a cooling chamber to store contents, closed by freezing chamber door 7 and a cooling chamber door 8, respectively. A dispenser 20 may be provided on the front surface of the freezing chamber door 7 or the cooling chamber door 8 to discharge, for example, water or ice on demand. In the exemplary refrigerator 9 shown in FIGS. 1A and 1B, the dispenser 20 is provided in the freezing chamber door 7. In the exemplary refrigerator 9 shown in FIG. 1C, the dispenser 20 is provided in the cooling chamber door 8. In either instance, the dispenser 20 is in communication with an ice maker 10 provided with or near the dispenser 20. However, the dispenser 20 may be provided in either the freezing chamber door 7 or the cooling chamber door 8, depending on a configuration of a particular refrigerator in which the dispenser 20 is installed.

Figure 4:
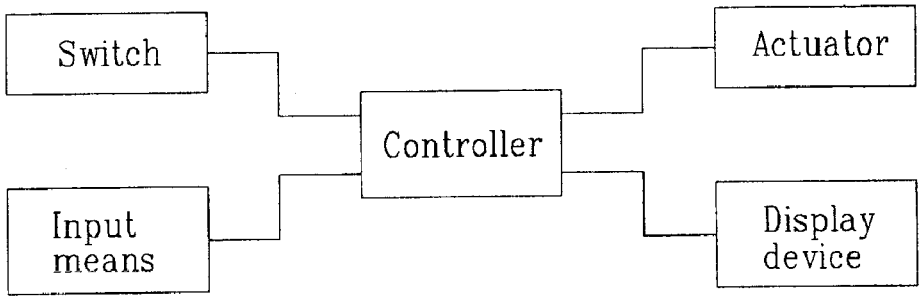
FIG. 4 is a schematic view of the dispenser shown in FIG. 2.

The dispenser 20 may include a cavity 23 that forms a space for discharging contents, such as, for example, ice or water, and a receiving portion 21 on which a container for receiving the discharged ice or water may be positioned. The dispenser 20 may also include a switch 22. The switch 22 may be disposed at one side of the dispenser 20 such that activation of the switch 22 causes ice or water to be discharged as requested. A display device 24 may display information related to an operation of the dispenser 20, and in certain embodiments may provide an input means for a user to input an operation mode. A schematic view of the arrangement of these components is shown in FIG. 4.

Figure 2:
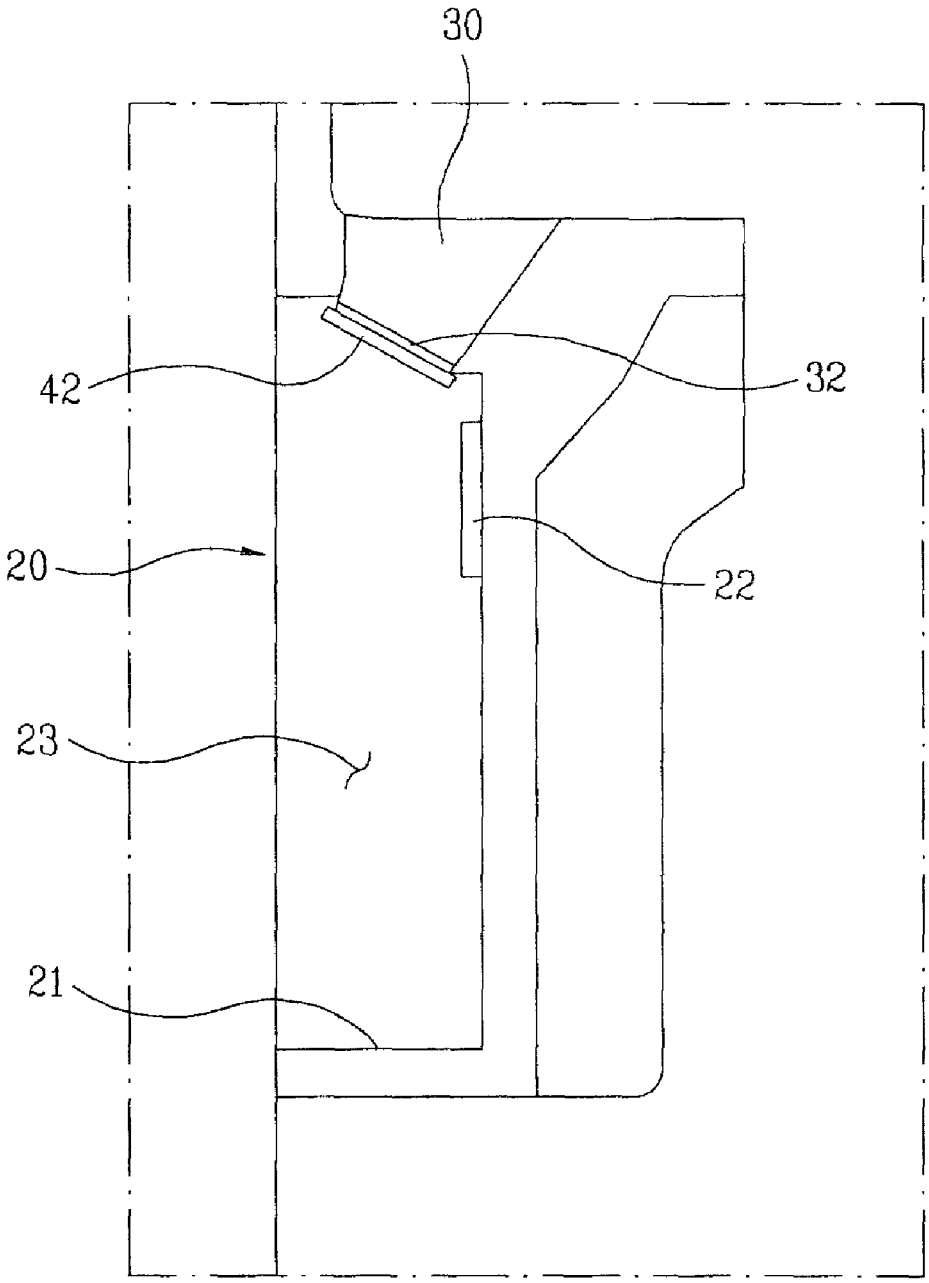
FIG. 2 is a cross-sectional view of a dispenser in accordance with embodiments as broadly described herein.
Figure 3:
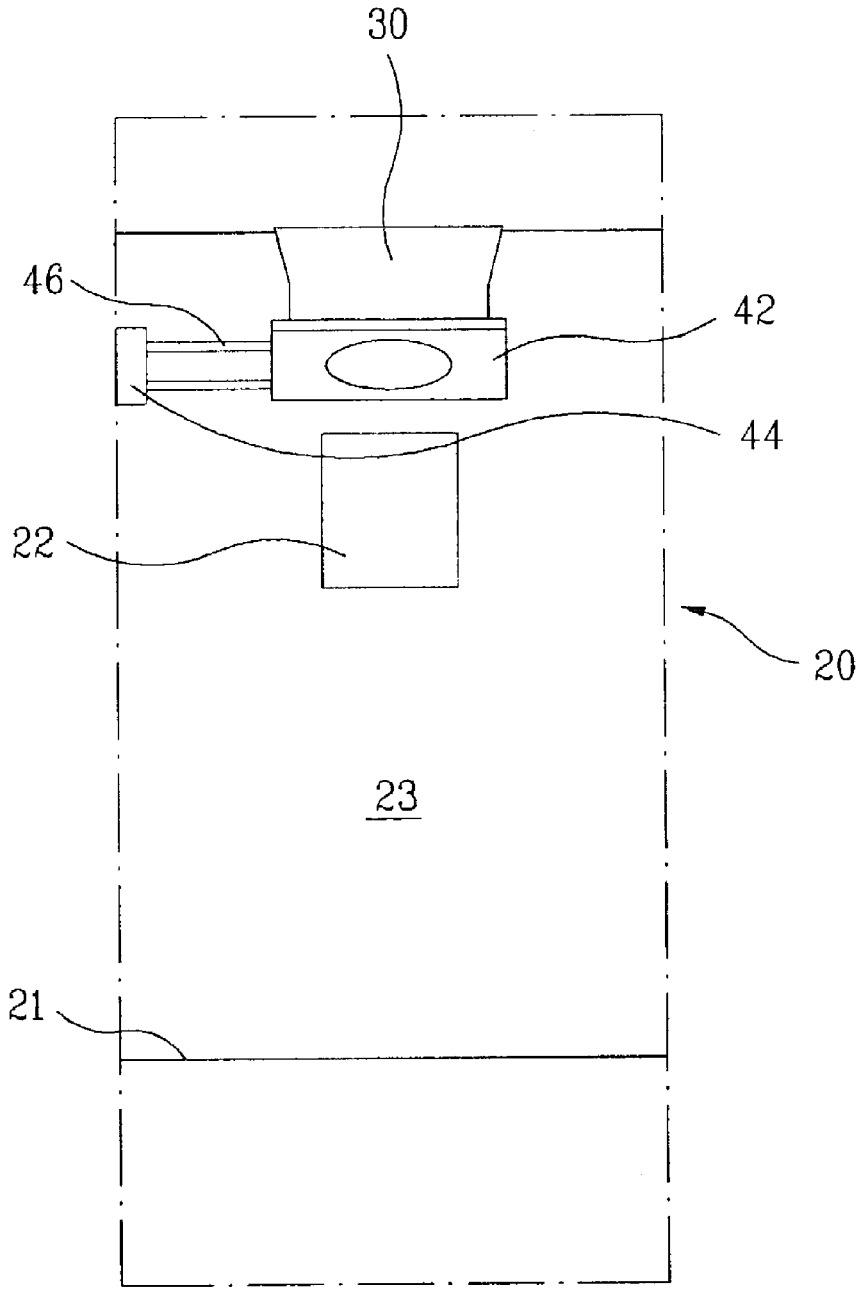
FIG. 3 is a front view of the dispenser shown in FIG. 2.

As shown in FIGS. 2 and 3, the dispenser 20 may include a chute 30 which discharges ice through an opening 32, a cover 42 which slides to selectively open or shut the opening 32, and first unit which causes the cover 42 to slide.

In the embodiment shown in FIGS. 2-6A, the chute 30 has a hollowed, substantially cylindrical shape. However, chutes having different and/or varying cross sections may also be appropriate. For example, the chute 30 may have an oblong or elliptical shape as shown in FIG. 6C to, for example, more easily accommodate a shape of ice being dispensed therethrough, or to further reduce an overall thickness of the dispenser 20. The chute 30 may guide ice transferred from an ice maker 10 disposed inside the refrigerator 9 to outside of the refrigerator.

The switch 22 may be disposed at one side of the dispenser 20 as appropriate to control the operation of the first unit. The embodiment shown in FIG. 2 includes an exemplary button that may be used to activate the switch 22. Other actuation mechanisms for the switch 22 may also be appropriate.

In the embodiment shown in FIG. 3, a first driver may include an actuator 44 and a guide member 46 that allows the cover 42 to slide relative to the opening 32.

Figure 5A:
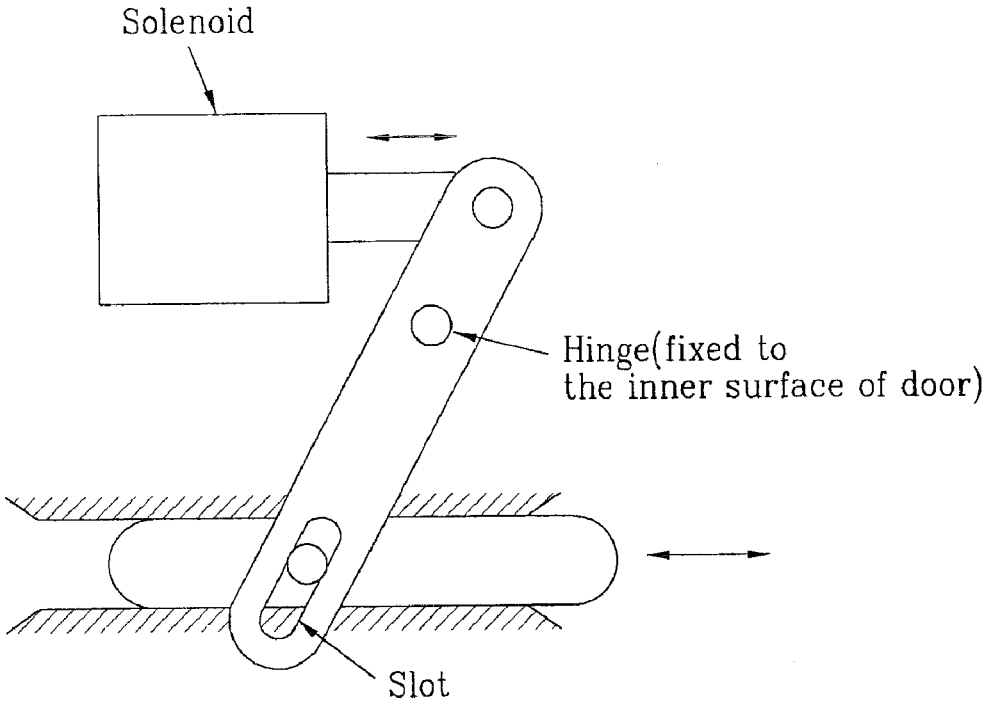
FIGS. 5A-5C illustrate exemplary actuators for dispensers as embodied and broadly described herein.
Figure 5B:
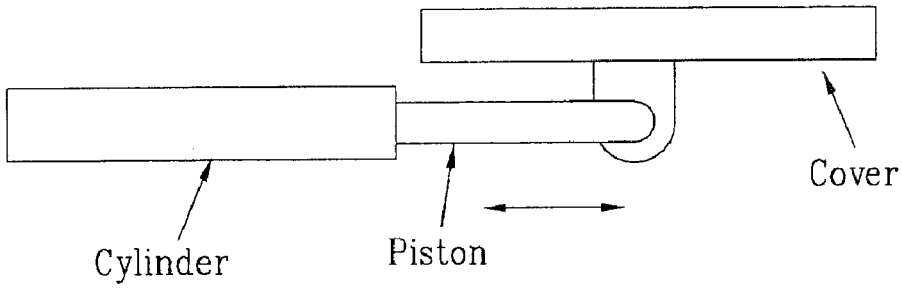
Figure 5C:
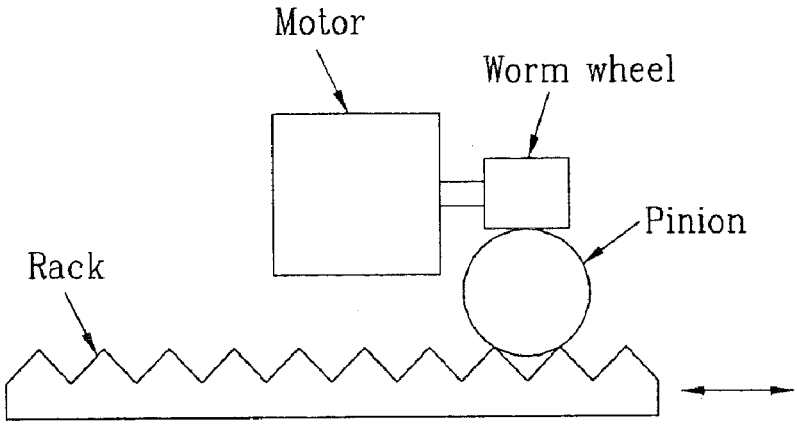

The actuator 44 may be, for example, a solenoid device, a piston device, a gear device, or any such device which can cause the cover 42 to selectively move. Examples of these types of actuators are shown in FIGS. 5A-5C.

If, for example, the actuator 44 is a solenoid device, the solenoid device may include a solenoid, and a guide rail provided on the cover 42. The cover 42 may then slide along the guide rail by actuating the solenoid. For example, a magnet may be provided on the cover 42 and the solenoid may be provided along a moving direction of the cover 42. As power is applied to the solenoid, either an attractive force or a repulsive force may be generated between the solenoid and the magnet so that the cover 42 can slide in substantially the same plane, or a plane that is adjacent and parallel to the opening 32 to either cover or uncover the opening 32 based on the type of force generated. Because the cover 42 slides in a plane which is adjacent and parallel to the opening 32, space required to effectively open and close the opening 32 in the chute 30 can be minimized when compared to an arrangement in which the cover would be hinged and rotate relative to the opening 32.

If, for example, the actuator 44 is a piston device, the piston device may include a hydraulic cylinder, an electric cylinder, or other such cylinder as appropriate. In this type of device, a cylinder may pull or push a piston to slide the cover 42 in a plane adjacent and parallel to the opening 32.

If, for example, the actuator 44 is a gear device, the gear device may include, for example, a rack gear disposed on the cover 42 and a pinion gear to engage with the rack gear. The pinion gear may be rotated by, for example, a motor or other such driving device so as to slide the cover 42 in substantially the same plane as the opening 32 to cover the opening 32.

The chute 30 provides for communication between the inside of the dispenser 20 and the outside of the dispenser 20 through the opening 32. The cover 42 may selectively seal the opening 32, thereby preventing loss of the cold air and the like when the dispenser 20 is not in use. The cover 42 may be formed of a material capable of shielding the opening 32. In certain embodiments, a portion of the cover 42 that contacts a rim portion of the opening 32 may be made of a flexible material such as, for example, rubber to provide an airtight seal.

The dispenser 20 may also include a second driver that presses the cover 42 against the opening 32 to seal the opening 32. A dispenser 20 including a second driver will be described with reference to FIGS. 6A-6C and 8.

Figure 6A:
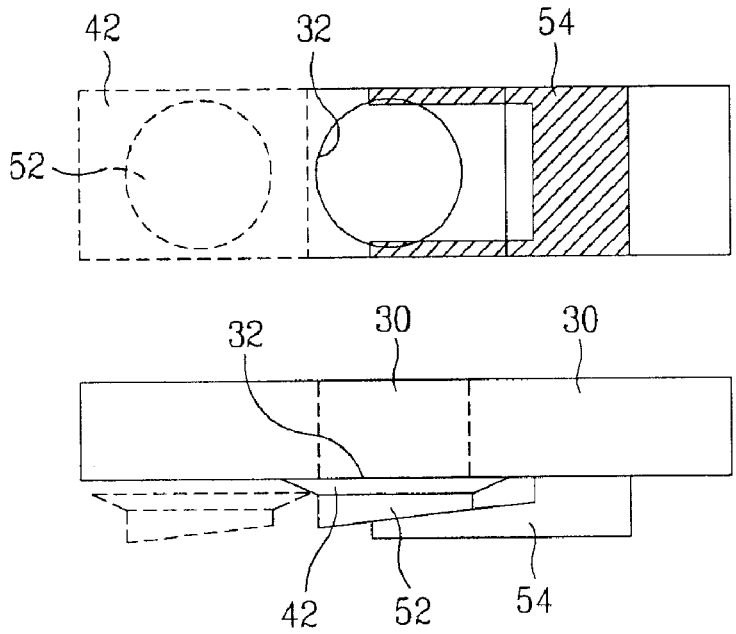
FIGS. 6A to 9 are cross sectional views of dispensers in accordance with embodiments as broadly described herein.

As shown in FIG. 6A, the second driver may include a protrusion 52 and a pressing guide 54. The pressing guide 54 may press the cover 42 toward the opening 32 such that the opening 32 is completely sealed by the cover 42, thereby preventing leakage of the contents of the dispenser 20 out through the opening 32. The pressing guide 54 may also press the cover 42 against the opening 32 to prevent cold air from leaking out.

As shown in FIG. 6A, the protrusion 52 may be formed on the bottom of the cover 42, and may have an inclined portion. The pressing guide 54 may be positioned adjacent to the opening 32, and may also include an inclined portion corresponding to the inclined portion of the protrusion 52. The inclined portion of the pressing guide 54 may be inclined in the same direction as the inclined portion of the protrusion 52.

In certain embodiments, the inclined portion of the pressing guide 54 may be formed such that a distance between the opening 32 and the pressing guide 54 becomes smaller as it progresses inward from an end portion of the pressing guide 54. In alternative embodiments, the inclined portion of the protrusion 52 may have a larger thickness at a position corresponding to an outer portion of the pressing guide 54, and a smaller thickness at a position corresponding to an inner portion of the pressing guide 54.

Accordingly, when the opening 32 is shut by the cover 42, the actuator 44 may cause the cover 42 to slide along the pressing guide 54 from an open position to a position in which the cover 42 confronts the opening 32. In this case, the inclined portion of the protrusion 52 formed on the cover 42 may engage with the inclined portion of the pressing guide 54. Consequently, the cover 42 is gradually moved and pressed against the opening 32 due to interaction between the inclined portion of the protrusion 52 and the inclined portion of the pressing guide 54.

Figure 6B:
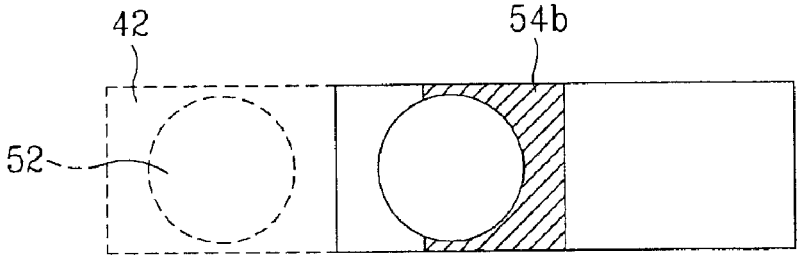
Figure 6C:
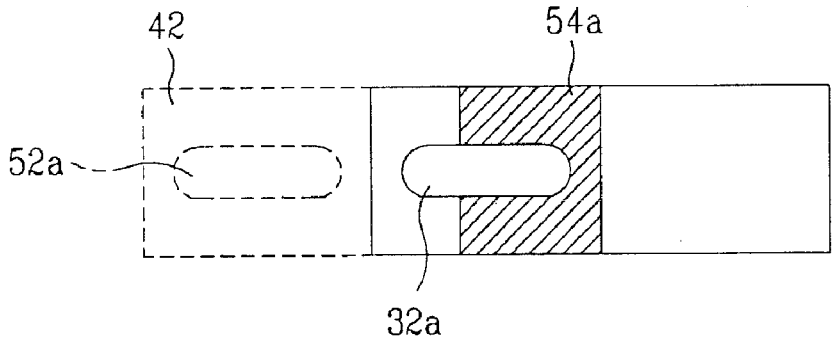

In alternative embodiments, the second unit may also include a pressing guide 54*b*, as shown in FIG. 6B, that has an outer periphery that conforms to a corresponding outer periphery of the opening 32. Likewise, a cross sectional area of the chute 30 and opening 32 may be substantially circular, as shown in FIGS. 4A-4B. Alternatively, a cross sectional area of the chute 30 may vary along its length, and the opening 32 may have other shapes. For example, as shown in FIG. 6C, the opening 32*a* may be elliptical, and the protrusion portion 52*a* of the cover 42 may be shaped similarly. Likewise, a periphery of the pressing guide 54*a* may correspond to the shape of the opening 32*a*.

Referring to FIGS. 3 and 6A, operation of the dispenser 20 having the second driver shown in FIG. 6A will now be described.

When a container is disposed on the receiving portion 21 and the switch 22 is actuated, the first driver drives the cover 42 to slide toward an open position relative to the opening 32. Then, content such as, for example, ice, may be discharged from the dispenser 20 into the container through the chute 30. When the operation of the switch 22 is stopped, the first driver slides the cover 42 to a closed position relative to the opening 32.

More specifically, the protrusion 52 provided on the cover 42 slides toward the pressing guide 54 so as to close off the opening 32. As the inclined portion of the protrusion 52 slides along the inclined portion of the pressing guide 54, the cover 42 presses against the opening 32 to form a seal therebetween. In certain embodiments, the cover 42 does not slide toward a closed position relative to the opening 32 until after operation of the switch 22 has been stopped and a predetermined amount of time has elapsed. Thus, even though the operation of the switch 22 has been stopped, residual contents may continue to be discharged through the chute 30.

Another embodiment of a cover opening/shutting structure for a dispenser will be described with reference to FIG. 7. As shown in FIG. 5, a magnet 57 may be provided on the opening 32 and a solenoid 56 may be provided on the cover 42. When the cover 42 is positioned to close off the opening 32, an attractive force is generated between the solenoid 56 and the magnet 57 by applying power to the solenoid 56. This attractive force causes the cover 42 to move in close contact with the opening 32 to seal the opening 32.

In certain embodiments, power to the solenoid 56 may be cut off as the cover 42 slides, and power may be applied to the solenoid 56 when the cover 42 is positioned so as to close off the opening 32. Although the magnet 57 is shown on the opening 32 and the solenoid 56 is shown on the cover 42 in FIG. 7, positions of the solenoid 56 and the magnet 57 may be reversed. Thus, the magnet 57 may be provided on the cover 42 and the solenoid 56 may be provided on the opening 32, and the same effect can be obtained.

Operation of the cover opening/closing structure shown in FIG. 7 will now be described.

When a container is disposed on the receiving portion 21 and the switch 22 is actuated, the first driver drives the cover 42 to slide to an open position relative to the opening 32. While power is not applied to the solenoid 56 provided on the cover 42, an attractive force is not generated between the solenoid 56 and the magnet 57 provided on the opening 32, and the first driver can easily slide the cover 42 towards an open position relative to the opening 32. Then, content such as, for example, ice may be discharged from the dispenser 20 into the container through the chute 30. When operation of the switch 22 is stopped, the first driver slides the cover 42 towards a closed position relative to the opening 32.

While the cover 42 slides towards the closed position relative to the opening 32, power is not applied to the solenoid 56, and the cover 42 can easily slide. When the cover 42 is in a position that completely closes off the opening 32, power may be applied to the solenoid 56. Then, an attractive force generated between the solenoid 56 and the magnet 57 causes the cover 42 to press against the opening 32.

In certain embodiments, when operation of the switch 22 is stopped, the cover 42 does not begin to slide towards a closed position relative to the opening 32 until a predetermined amount of time has elapsed. Thus, even though the operation of the switch 22 is stopped, residual contents may continue to be discharged from the dispenser 20 through the chute 30.

Further, any contents which begin to be discharged from the dispenser 20 during operation of the may be discharged after the operation of the switch 22 is stopped. This predetermined time interval before the cover 42 slides to the closed position prevents residual contents, such as, for example, ice, from remaining in the chute 30 and melting.

An opening/shutting structure for a dispenser in accordance with another embodiment will be described with reference to FIG. 8.

Figure 8:
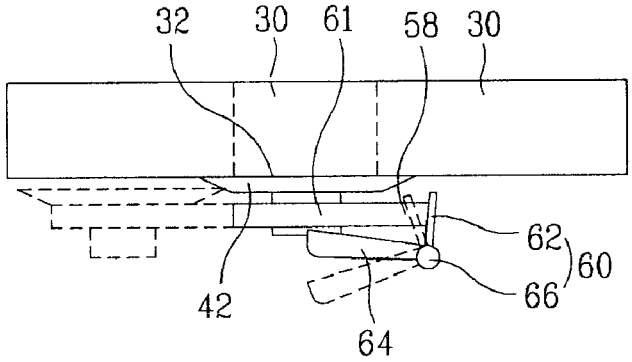

The structure shown in FIG. 8 may include a link unit 60 to press the cover 42 against the opening 32. The link unit may include a first member 62 which rotates around a fixed axis 66, and a second member 64 connected to the first member 62. The second member 64 rotates around the fixed axis 66 with the rotation of the first member 62. An actuating member 61 may be provided on the cover 42. As the cover 42 slides, the actuating member 61 contacts and pushes against the first member 62. When the first member 62 is pushed by the actuating member 61, the first member 62 rotates around the fixed axis 66, thus causing the second member 64 to rotate. As the second member 64 rotates, an end portion of the second member 64 presses against the cover 42, thus pressing the cover 42 against the opening 32.

In certain instances, the second member 64 may collide with ice that is discharged through the opening 32. In order to prevent collision between the second member 64 and discharged ice, the second member 64 may have a width that gradually increases from the fixed axis 66 toward the opposite end portion of the second member 64 that presses against the cover 42. The larger width of the end portion of the second member 64 shown in FIG. 8 may provide sufficient strength to withstand an impact due to any collision between the second member 64 and discharged ice. This larger width may also increase pressing force imparted on the cover 42 by the second member 64.

Operation of the covering opening/closing structure shown in FIG. 8 will now be described. When a container is disposed on the receiving portion 21 and the switch is actuated, the first unit drives the cover 42 to slide towards an open position relative to the opening 32. Then, content, such as, for example, ice, is discharged from the dispenser 20 into the container through the chute 30. When operation of the switch 22 is stopped, the first driver slides the cover 42 towards a closed position relative to the opening 32.

As the cover 42 slides toward the closed position, the actuating member 61 provided on the cover 42 pushes against the first member 62. Then, the first member 62 rotates around the fixed axis 66 to rotate the second member 64. As the cover 42continues to slide toward the closed position, the actuating member 61 continues to rotate the first member 62 and the first member 62 continues to rotate the second member 64. As a result, the second member 64 applies a gradually increasing pressure to the cover 42, causing the cover 42 to press against the opening 32. In certain embodiments, the cover 42 does not begin to slide towards the closed position until a predetermined amount of time has elapsed. This allows contents to continue to be discharged through the chute 30 even though operation of the switch 22 has stopped. Further, contents which begin to be discharged during operation of the switch 22 may continue to be discharged after operation of the switch 22 has stopped.

Figure 9:
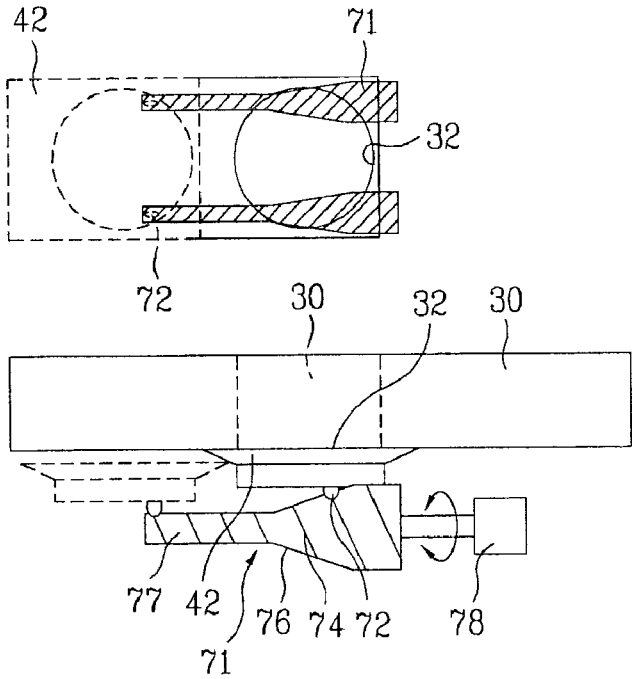
Figure 10A:
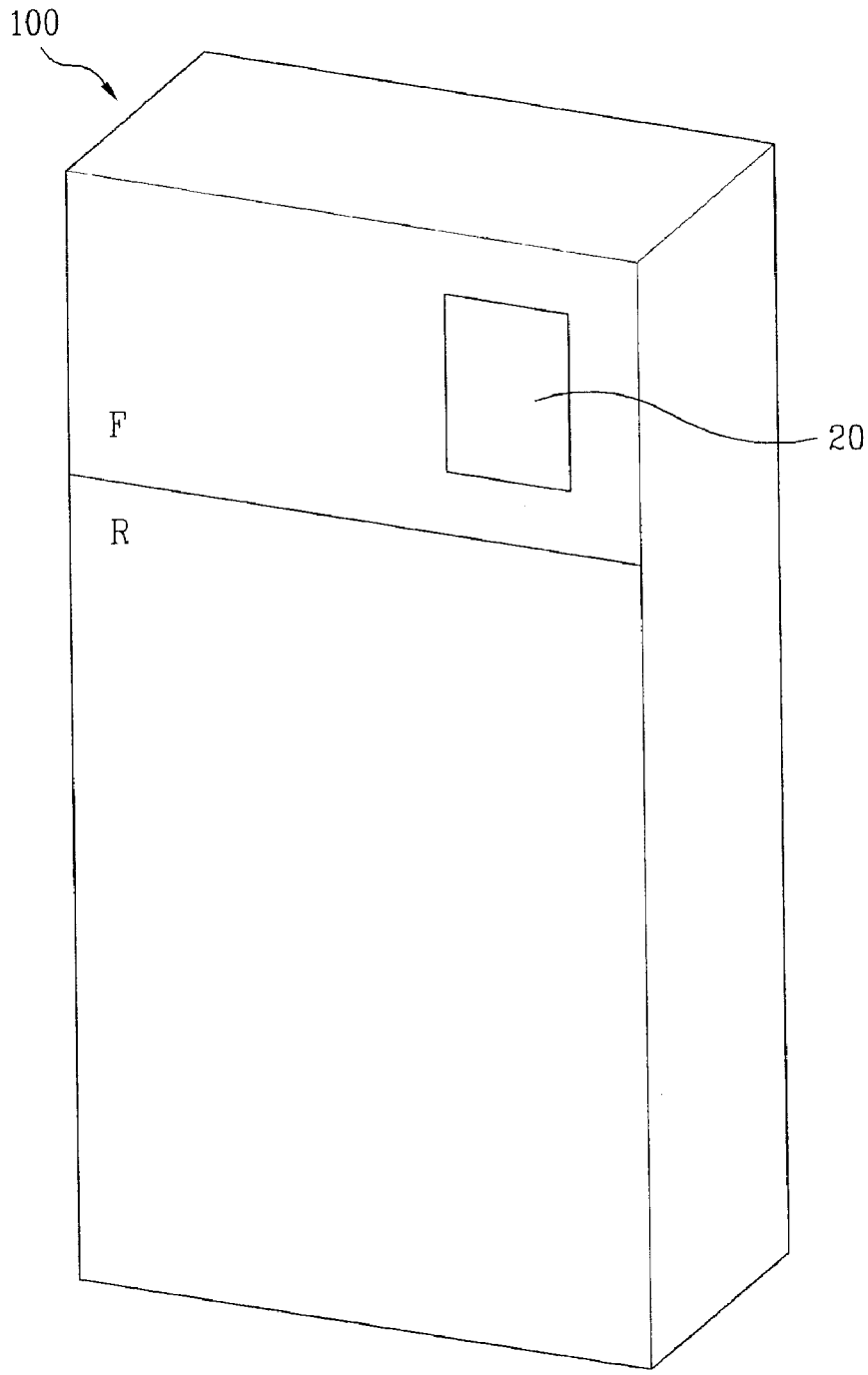
FIGS. 10A-10G illustrate dispensers as embodied and broadly described herein installed in exemplary refrigerating systems.
Figure 10B:
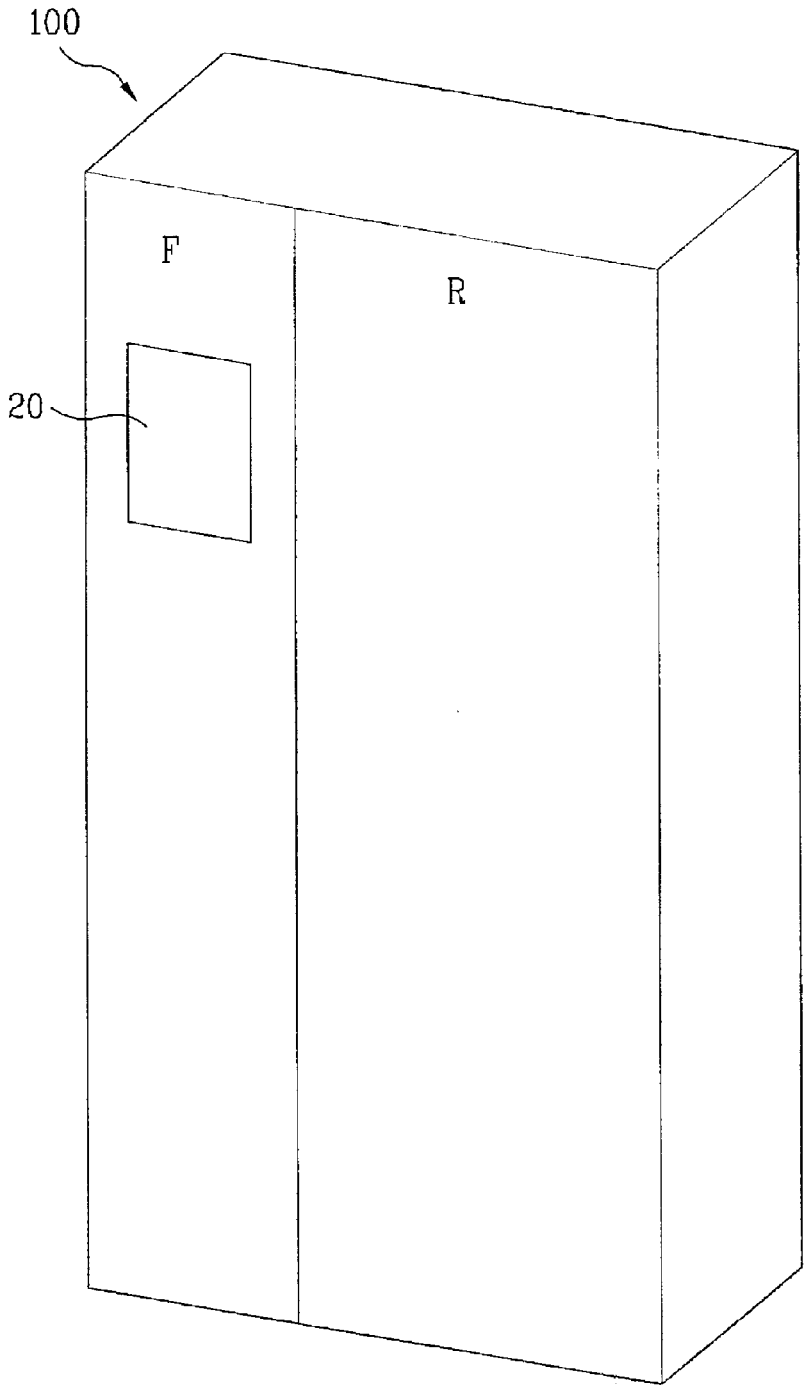
Figure 10C:
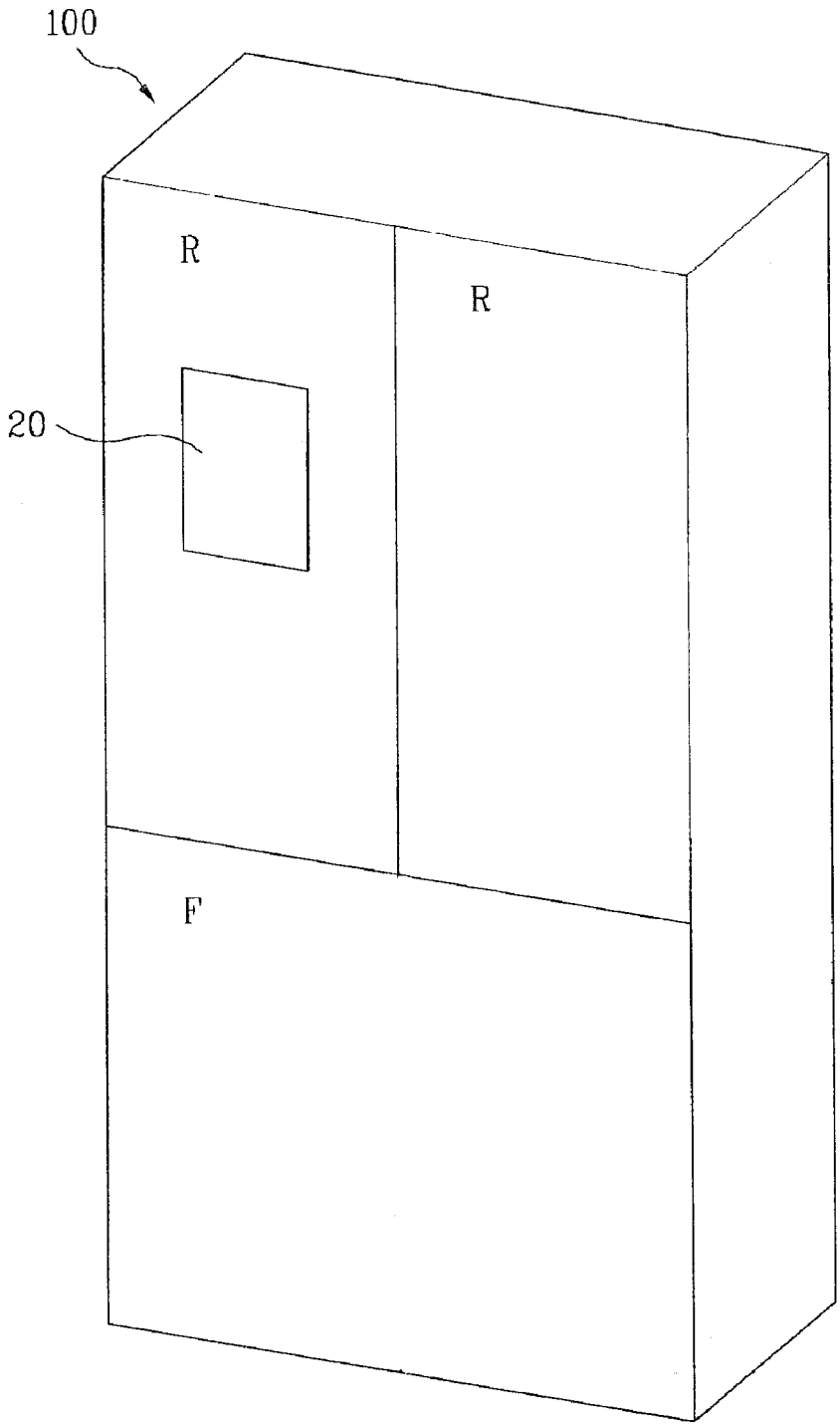
Figure 10D:
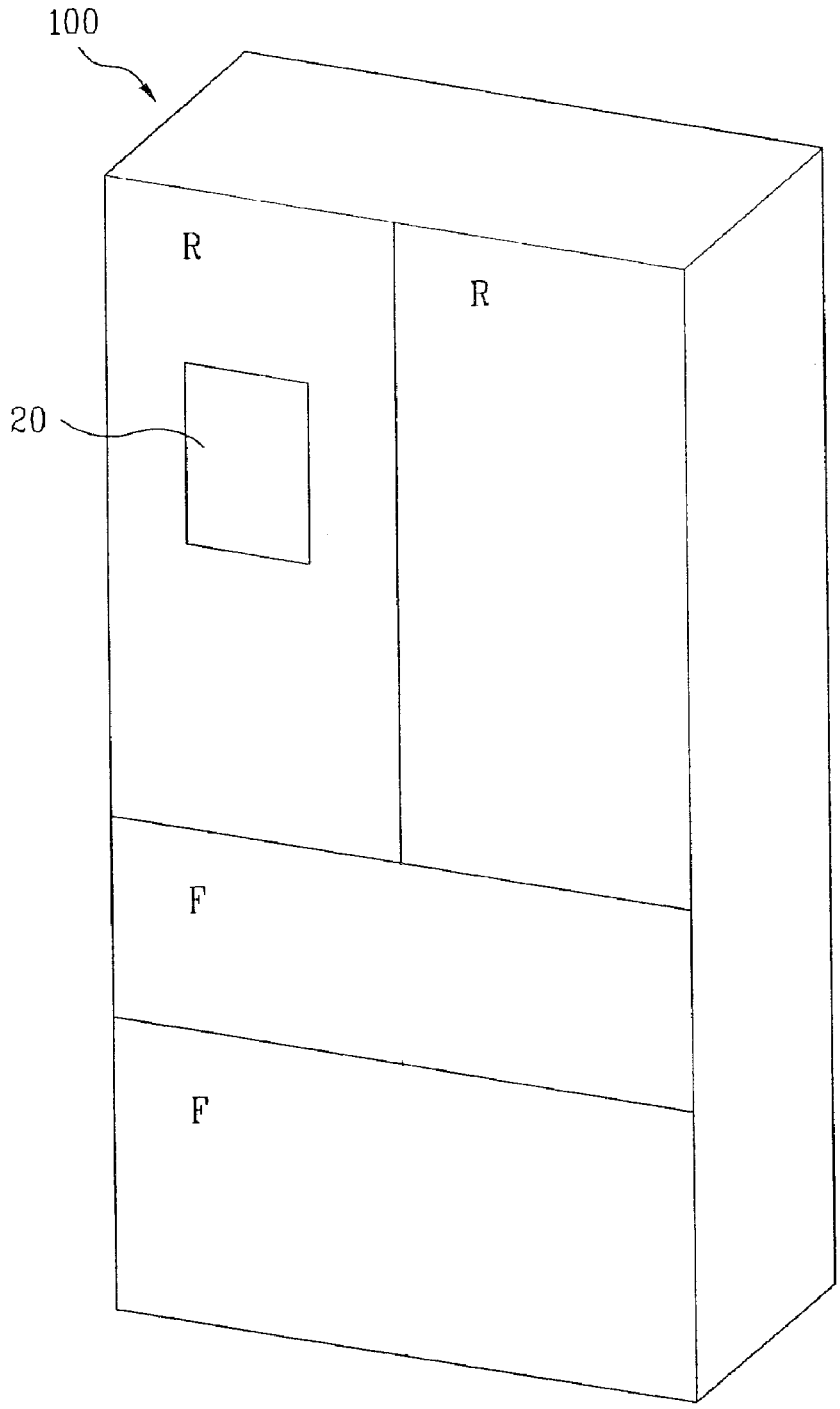
Figure 10E:
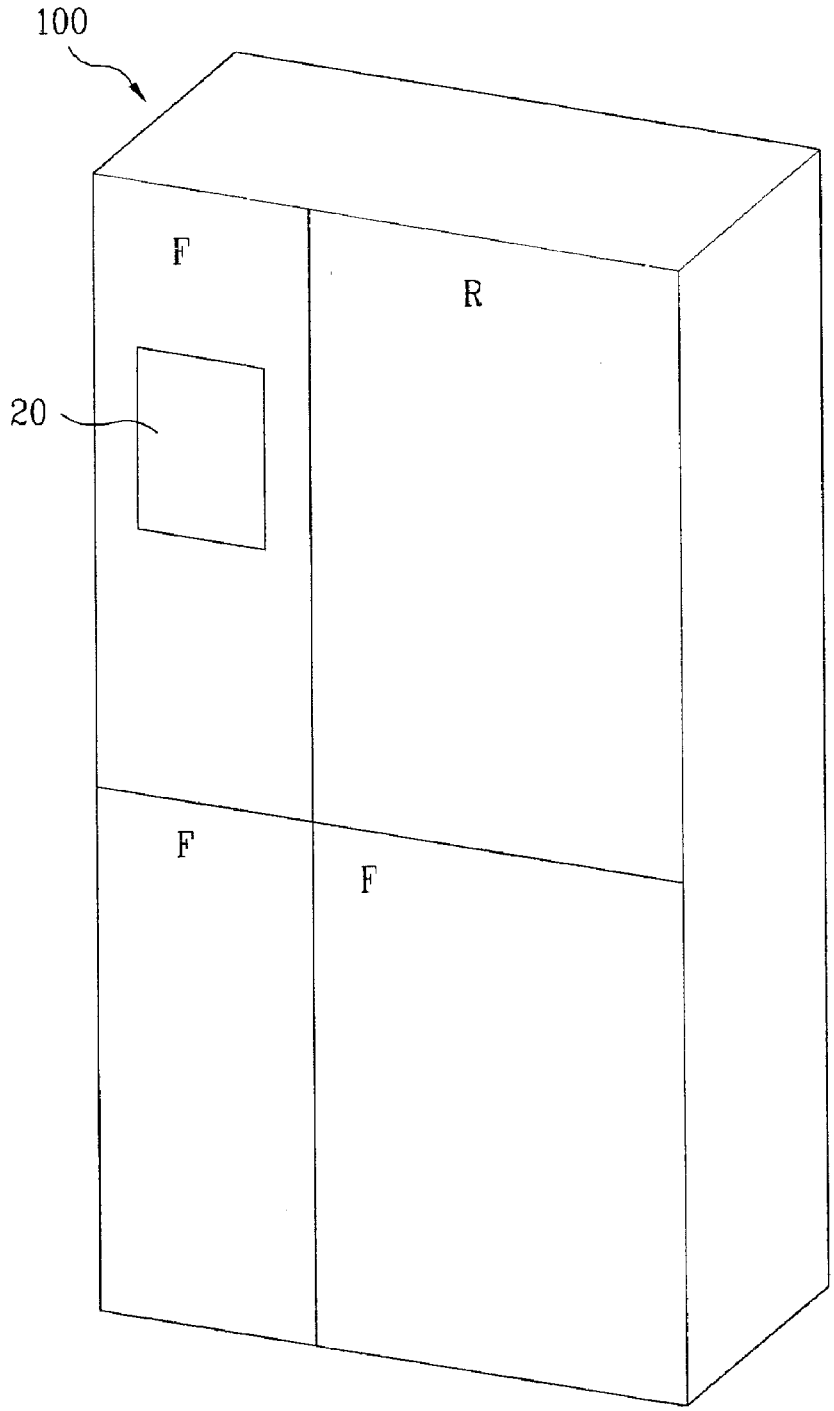
Figure 10F:
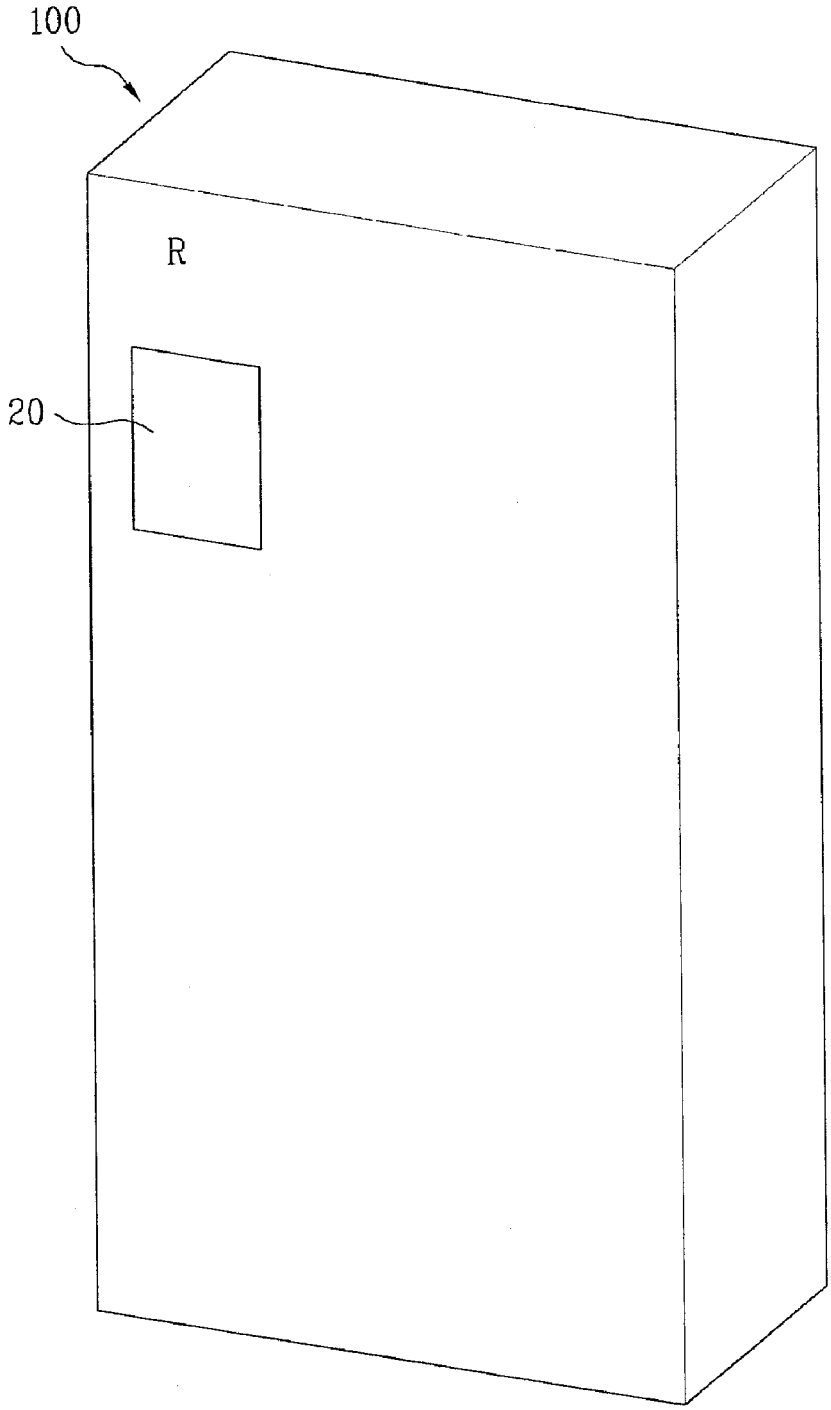
Figure 10G:
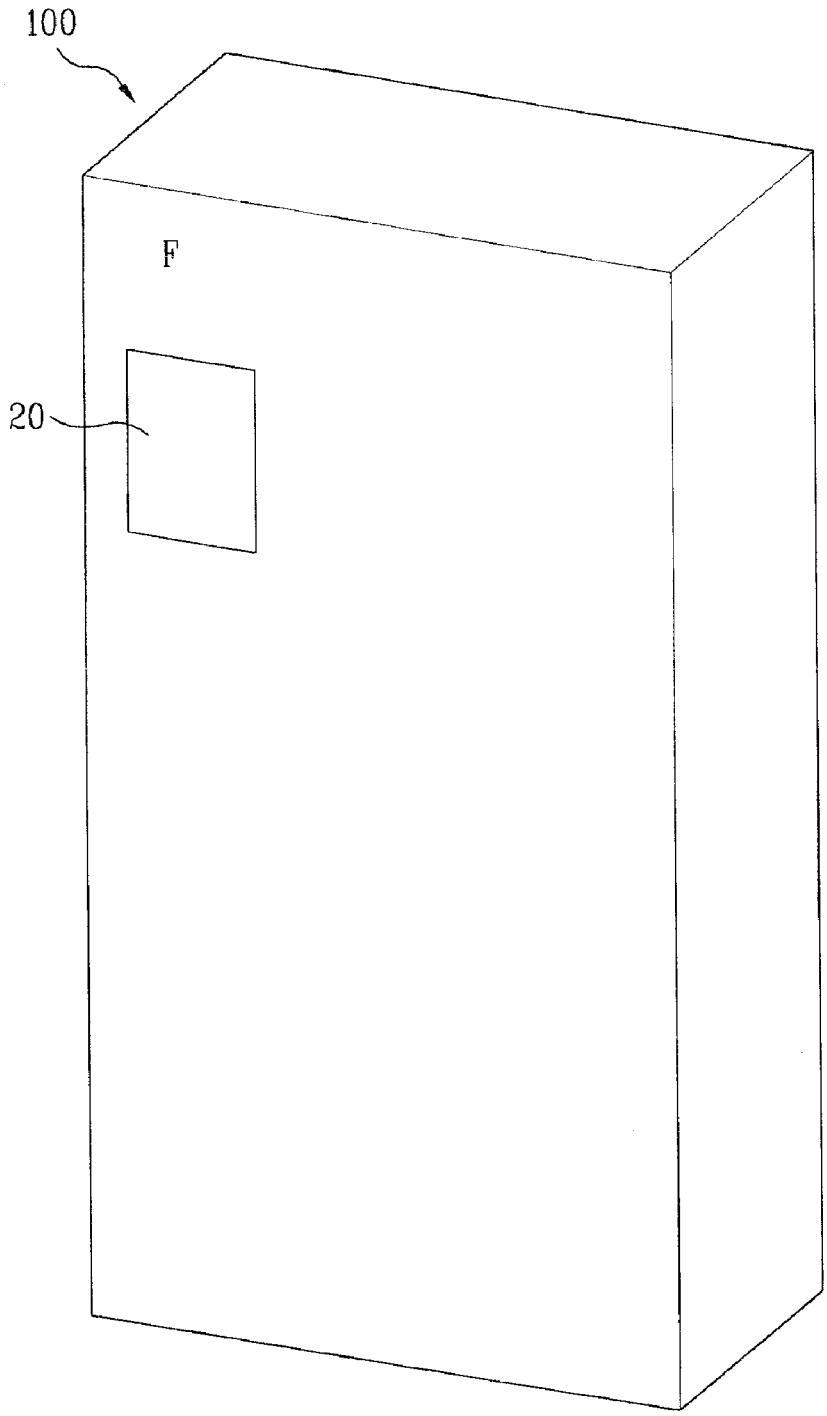

An opening/closing structure for a dispenser in accordance with another embodiment is shown in FIG. 9. This structure may include a third driver which enables both pressing and sliding of the cover.

Figure 7:
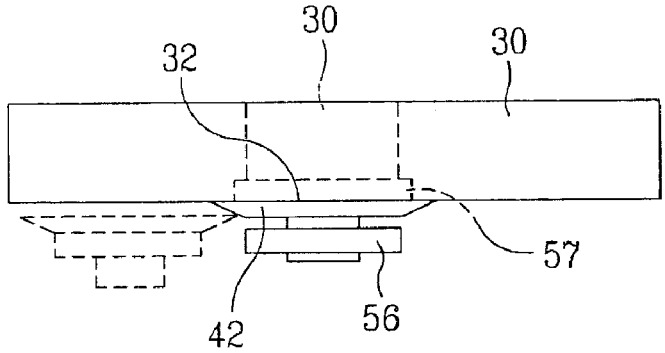

The third driver shown in FIG. 7 may be a gear unit. The gear unit may include a motor 78, at least one gear member 71 and a protruding member 72 provided on one side of the cover 42. A spiral groove 74 may be formed on the gear member 71. The gear member 71 may include a uniform portion 77 having a uniform diameter and a tapered portion 76 having a gradually increasing/decreasing diameter.

The protruding member 72 may engage with the spiral groove 74 of the gear member 71. The gear member 71 may rotate by driving the motor 78. The engagement between protruding member 72 and the spiral groove 74 causes the protruding member 72 to move along the spiral groove 74 as the gear member 71rotates, thus causing the cover 42 to slide. As the protruding member 72 moves from the uniform portion 77 toward the tapered portion 76 of the gear member 71, the cover 42 moves toward the opening 32, and a pressing force exerted on the opening 32 by the cover 42 gradually increases. Thus, the gear unit enables both sliding of the cover 42 and pressing of the cover 42 against the opening 32.

Operation of the structure shown in FIG. 9 will now be described.

When a container is disposed on the receiving portion 21 and the switch 22 is actuated, the motor 78 of the gear unit is driven to rotate the gear member 71 in a first direction. Rotation of the gear member 71 causes protruding member 72 formed on the cover 42 to move along the spiral groove 74 such that cover 42 slides towards an open position relative to the opening 32 (shown in shadow in FIG. 9). In the closed position, the protruding member 72 is positioned in a part of the groove 74 formed on the tapered portion 76 of the gear member 71. To move to the open position, the protruding member 72 moves along the groove 74 from the tapered portion 76 to the uniform portion 77.

After content, such as, for example, ice, is discharged through the opening 32, the cover 42 slides towards a closed position relative to the opening 32. That is, a rotational direction of the motor 78 reverses, and the protruding member 72 formed on the cover 42 moves along the spiral groove 74 in an opposite direction such that cover 42 slides towards a closed position relative to the opening 32.

While the protruding member 72 moves along the spiral groove 74 formed on the tapered portion 76 of the gear member 71, a pressing force exerted on the opening 32 by the cover 42 gradually increases due to the gradually increasing diameter of the tapered portion 76. The cover 42 then presses against the opening 32 simultaneously as the cover 42 slides shut relative to the opening 32.

In certain embodiments, the cover 42 does not begin to slide towards the closed position until a predetermined amount of time has elapsed. This allows contents to continue to be discharged through the chute 30 even though operation of the switch 22 has stopped. Further, contents which begin to be discharged during operation of the switch 22 may continue to be discharged after operation of the switch 22 has stopped.

The exemplary dispenser presented herein may be easily applied to a variety of different types of refrigerating systems in which this type of dispensing of contents such as, for example, fluids and/or ice, is required and/or advantageous.

More specifically, the various embodiments of an opening/closing structure for a dispenser as embodied and broadly described herein have numerous applications in different types of refrigerating systems. FIGS. 10A-10G each show a refrigerating system 100 that includes one or more refrigerating chambers R and one or more freezing chambers F. Each refrigerating system 100 shown in FIGS. 10A-10G includes a dispenser 20 as embodied and broadly described herein. Installation and functionality of dispensers in refrigerating systems is discussed in detail in U.S. Pat. Nos. 7,076,967, 6,135,173, 6,109,476 and 5,117,654, the entirety of which are incorporated herein by reference.

In embodiments of a dispenser as broadly described herein, the cover moves horizontally to open or shut the opening of the chute. Accordingly, a space occupied by the dispenser may be minimized. In a case in which the dispenser is disposed in the refrigerator, and particularly, in the door of the refrigerator, an installation space may be minimized and utility of the door space may be improved.

Further, embodiments of a dispenser as broadly described herein include a cover that blocks access to the chute and to internal electrical and mechanical ice making components of the dispenser when the dispenser is not in use. The sliding motion of the cover between the open and closed positions can be initiated quickly and with a minimal amount of noise.

A dispenser is provided that is capable of reducing a space where the dispenser occupies and enlarging a usable space of a refrigerator and a refrigerator including the same.

A dispenser as embodied and broadly described herein includes a chute which guides contents which are discharged to outside through an opening provided on an end of the chute, a cover which selectively opens or shuts the opening and a first unit which drives the cover to slide to open or shut the opening.

The dispenser may also include a second unit which presses the cover to seal the opening.

The first unit may include a solenoid to generate magnetic force to selectively slide the cover.

The first unit may include a piston device to generate driving force to allow the cover to move substantially rectilinearly.

The first unit may include a motor which has a rotating shaft, a pinion gear which rotates with the rotating shaft, and a rack gear disposed on the cover to engage with the pinion gear to allow the cover to slide.

The dispenser may also include a switching device which allows the first unit to be selectively actuated by a user.

The second unit may include a protrusion provided on the cover to have an inclined portion, and a pressing guide which has an inclined portion to allow the cover to press the opening, wherein the inclined portion of the protrusion slides along the inclined portion of the pressing guide when the cover slides.

The pressing guide may include a first guide which occupies a predetermined region on an interior side of a border of the opening, and a second guide which occupies another predetermined region on the interior side of the border of the opening to be opposite to the first guide, wherein the contents are discharged through a region of the opening excluding the regions occupied by the first and second guides.

The second unit may include a link unit which allows the cover to press the opening by converting sliding force of the cover to pressing force of the cover.

The link unit may include an actuating member provided on the cover, a first link which rotates with respect to a fixed axis by the actuating member according to sliding motion of the cover, and a second link which rotates with respect to the fixed axis by rotating motion of the first link to press the cover to seal the opening.

The second link may have a width increasing more and more as going to a free end of the second link.

The second unit may include a magnetic unit which allows the cover to press the opening by magnetic force between the cover and the opening.

The magnetic unit may include a first magnetic member which is provided on one of the cover and an end portion of the chute and formed of one of a magnet and a solenoid, and a second magnetic member which is provided on the other one of the cover and the end portion of the chute and formed of the other one of a magnet and a solenoid, wherein attractive force is selectively generated between the first magnetic member and the second magnetic member.

In another embodiment as broadly described herein, a dispenser may include a chute which guides contents which are discharged to outside through an opening provided on an end of the chute, a cover which selectively opens or shuts the opening, and a third unit which drives the cover to slide to open or shut the opening, and presses the cover to seal the opening.

The third unit may include a gear unit which allows the cover to move substantially rectilinearly as the cover shuts the opening tightly.

The gear unit may include a protruding member provided on the cover, a motor which generates driving force, and a gear member which rotates by the motor, wherein the gear member has a spiral groove along which the protruding member moves substantially rectilinearly to allow the cover to slide, and a tapered portion having a tapered surface to pressurize the cover to seal the opening.

In another embodiment as broadly described herein, a refrigerator may include a case which has at least one cooling room, a door which opens or closes the cooling room, and a dispenser installed in one of the cooling room and the door, wherein the dispenser includes a chute which guides contents which are discharged to outside through an opening provided on an end of the chute, a cover which selectively opens or shuts the opening, and a first unit which drives the cover to slide to open or shut the opening.

The refrigerator may also include a second unit which presses the cover to seal the opening.

In another embodiment as broadly described herein, a refrigerator may include a case which has at least one cooling room, a door which opens or closes the cooling room, and a dispenser installed in one of the cooling room and the door, wherein the dispenser includes a chute which guides contents which are discharged to outside through an opening provided on an end of the chute, a cover which selectively opens or shuts the opening, and a third unit which drives the cover to slide to open or shut the opening, and presses the cover to seal the opening.

Any reference in this specification to "one embodiment," "an exemplary," "example embodiment," "certain embodiment," "alternative embodiment," and the like means that a particular feature, structure, or characteristic described in connection with the embodiment is included in at least one embodiment as broadly described herein. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, numerous variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A dispenser for a refrigerator, comprising:

a chute configured to guide contents from an interior to an exterior of a refrigerator through an opening provided at an end of the chute;

a cover slidably coupled to the chute and configured to selectively open and close the opening; and a driving system that moves the cover in two different directions relative to the opening, wherein the driving system comprises:

a first driver that slidably moves the cover in a first direction relative to the opening; and a second driver that moves the cover in a second direction relative to the opening so as to press the cover against the opening to seal the opening, wherein the second driver includes:

a protrusion provided on the cover, wherein the protrusion includes an inclined portion; and a pressing guide, wherein the pressing guide includes an inclined portion, and wherein the inclined portion of the protrusion is configured slide along the inclined portion of the pressing guide as the cover slides relative to the opening.

2. The dispenser of claim 1, wherein the first driver includes a solenoid configured to generate a magnetic force, wherein the magnetic force selectively slides the cover relative to opening.

3. The dispenser of claim 1, wherein the first driver includes a piston device configured to generate a driving force, wherein the driving force moves the cover substantially rectilinearly.

4. The dispenser of claim 1, wherein the first driver includes:

a motor having a shaft;

a pinion gear configured to rotate with the shaft; and a rack gear provided on the cover and configured to engage with the pinion gear so as to slide to cover in response to a rotation of the shaft and a corresponding rotation of the pinion gear.

5. The dispenser of claim 1, further comprising a switch, wherein the switch is configured to selectively actuate the first driver.

6. The dispenser of claim 5, further comprising a controller configured to control operation of the dispenser and to receive a signal from the switch and open or close the cover based on the signal received from the switch.

7. The dispenser of claim 5, wherein the switch is configured to transmit a signal to the controller to open the cover when the switch is actuated, and to close the cover when the switch is de-actuated.

8. The dispenser of claim 7, wherein the controller is configured to delay a closing of the cover for a predetermined amount of time after it receives the signal from the switch to close the cover.

9. The dispenser of claim 5, further comprising a controller, wherein the controller is configured to receive a signal from the switch and to selectively open and close the cover based on the signal received from the switch.

10. The dispenser of claim 9, wherein the switch is configured to send a signal to the controller to open the cover when the switch is actuated, and to close the cover when the switch is de-actuated.

11. The dispenser of claim 10, wherein the controller is configured to delay a closing of the cover for a predetermined amount of time in response to the de-actuation of the switch and corresponding signal.

12. The dispenser according to claim 1, wherein the pressing guide includes:

a first guide portion provided at a first predetermined region extending along a first peripheral portion of the opening such that the opening is unobstructed; and a second guide portion provided at a second predetermined region extending along a second peripheral portion of the opening opposite the first guide portion such that the opening is unobstructed.

13. The dispenser of claim 1, wherein the protrusion extends outward from an outer surface of the cover that is opposite an inner surface of the cover that confronts the opening.

14. The dispenser of claim 1, wherein the inclined portions of the protrusion and the pressing guide are configured to gradually press the cover against the opening as the cover slides from an open position towards a closed position relative to the opening.

15. The dispenser of claim 1, wherein the first driver slidably moves the cover in a plane which is adjacent and parallel to a plane defined by the opening of the chute.

16. A refrigerator comprising the dispenser of claim 1.

17. A refrigerator, comprising:

a main body having at least one storage chamber formed therein;

a door rotatably coupled to the main body; and a dispenser installed in one of the storage chamber or the door, wherein the dispenser includes:

a chute configured to guide contents from the storage chamber through an opening provided at an end of the chute;

a cover configured to selectively open or close the opening;

a first driver configured to slidably move the cover relative to the opening; and a second driver configured to press the cover against the opening so as to form a seal therebetween, wherein the second driver includes:

a protrusion provided on the cover, wherein the protrusion includes an inclined portion; and a pressing guide, wherein the pressing guide includes an inclined portion, and wherein the inclined portion of the protrusion is configured to slide along the inclined portion of the pressing guide as the cover slides relative to the opening.

* * * * *